US010012374B2

(12) United States Patent
Zhou

(10) Patent No.: US 10,012,374 B2
(45) Date of Patent: Jul. 3, 2018

(54) LAMP STRUCTURE

(71) Applicant: ZHENG DONG LIGHTING CO., LTD., Guangdong Province (CN)

(72) Inventor: Xing-Dong Zhou, Guangdong Province (CN)

(73) Assignee: Zheng Dong Lighting Co., Ltd., Guangdong (CN)

( * ) Notice: Subject to any disclaimer, the term of this patent is extended or adjusted under 35 U.S.C. 154(b) by 9 days.

(21) Appl. No.: 15/206,474

(22) Filed: Jul. 11, 2016

(65) Prior Publication Data

US 2018/0010779 A1 Jan. 11, 2018

(51) Int. Cl.

| | |
|---|---|
| ***F21V 29/00*** | (2015.01) |
| ***F21V 25/00*** | (2006.01) |
| ***F21V 17/12*** | (2006.01) |
| ***F21V 19/00*** | (2006.01) |
| ***F21V 17/14*** | (2006.01) |
| ***F21V 29/503*** | (2015.01) |
| ***F21V 29/85*** | (2015.01) |
| ***F21V 29/507*** | (2015.01) |
| ***F21V 23/02*** | (2006.01) |
| *F21Y 115/10* | (2016.01) |

(52) U.S. Cl.

CPC ..... *F21V 25/00* (2013.01); *F21V 17/12* (2013.01); *F21V 17/14* (2013.01); *F21V 19/0055* (2013.01); *F21V 23/023* (2013.01); *F21V 29/503* (2015.01); *F21V 29/507* (2015.01); *F21V 29/85* (2015.01); *F21Y 2115/10* (2016.08)

(58) Field of Classification Search

CPC ..... F21V 25/00; F21V 29/503; F21V 29/507; F21V 29/85; F21V 23/023

See application file for complete search history.

(56) References Cited

U.S. PATENT DOCUMENTS

| | | | | |
|---|---|---|---|---|
| 2,514,015 | A * | 7/1950 | Sutter | H01F 27/40 174/521 |
| 6,682,036 | B1 * | 1/2004 | Hsu | F21S 8/04 248/342 |
| 9,041,303 | B2 * | 5/2015 | Yoon | H05B 33/0821 315/192 |
| 9,200,794 | B2 * | 12/2015 | Clifford | F21V 29/02 |
| 2004/0095752 | A1 * | 5/2004 | Hsu | F21S 8/04 362/147 |

(Continued)

*Primary Examiner* — Evan Dzierzynski

(74) *Attorney, Agent, or Firm* — Rosenberg, Klein & Lee

(57) ABSTRACT

The present invention discloses a lamp structure. An accommodating cavity is provided for disposing a lamp board. An insulating unit seals the opening of the accommodating cavity for preventing accidental electric shocks when a user cleans or maintains the lamp structure. Placing the lamp board inside the accommodating cavity, the space occupied by the lamp board on the base may be saved. The insulating unit may prevent foreign matters or water from contacting the lamp board and resulting in short circuit or failure in the lamp board. One or more heat dissipating unit may be disposed in the accommodating cavity and used as the heat dissipating structure for the lamp board. A recess may be disposed on an inner side of the accommodating cavity. The recess communicates with the accommodating cavity. A capacitor may be disposed in the recess and connected electrically to the lamp board.

9 Claims, 5 Drawing Sheets

(56) References Cited

U.S. PATENT DOCUMENTS

| | | | | |
|---|---|---|---|---|
| 2010/0014289 | A1* | 1/2010 | Thomas | F21V 15/01<br>362/235 |
| 2012/0057344 | A1* | 3/2012 | Wang | F21S 8/046<br>362/235 |

* cited by examiner

LAMP STRUCTURE

FIELD OF THE INVENTION

The present invention relates to a lamp structure, and particularly to a lamp structure powered by an alternate-current (AC) power source for lighting.

BACKGROUND OF THE INVENTION

Light-emitting diodes (LEDs) own the advantages of small size, long lifetime (reaching 100 thousand hours in the normal environment), low power consumption, low heat generation, high power efficiency, short response time, high impact endurance, and high monochromaticity.

By contrast, the lamps according to the prior art (tungsten filament incandescent lamps, halogen lamps, fluorescent lamps) have the disadvantages of large size, short lifetime, high power consumption, high heat generation, low power efficiency, and pollution. Accordingly, increasingly more industries have replaced the lamps according to the prior art with LED lamps. LED lamps are extensively applied in the fields such as indicators, displays, lighting, communication, and biotechnologies, and definitely will become the mainstream products in the future. Thanks to the significant progresses in research and development, LED lamps are popularized and have certainly become the direction of development for the new era.

The LED lighting equipment has the advantage of compact size and saving space. Consequently, the market share of its application in domestic decoration is increasing. For example, LEDs are adopted as the light sources in the ceiling lamps and the bulb-type lamps according to the prior art, which are installed on walls according to uses' requirements.

A ceiling LED lamps comprises a base, a LED circuit board, and a lampshade. The base is fixed to the installation wall; the LED circuit board and the lampshade are disposed on the base. The spatial pattern, angle, brightness of the light emitted from the LED circuit board vary according to the lampshade and the design of the LED circuit board.

According to the structure and disposition of the ceiling LED lamps according to the prior art, the heat generated by the LED light source and the circuit board is conducted to the wall via the base. Alternatively, some space is reserved between the lampshade and the base for heat dissipation. Nonetheless, the heat conduction in these designs is inferior, resulting in the drawbacks of low heat dissipating efficiency and reduced lifetime in the ceiling LED lamps.

In addition, depending on the design, the circuit board of the ceiling LED lamps may be supplied by a DC or AC power source. In the respect of cleaning and maintenance, if electricity leaks in the lamp board, people might be hurt by touching. There is no protection designs in ceiling LED lamps according to the prior art for preventing the influences of electricity leaks in the lamp board on human bodies.

Moreover, in general, the lamp board of a ceiling LED lamp is fixed on the base directly. Since there is no zoom for accommodating the lamp board in the base, the space for the lamp board must occupy a certain space in the corresponding lampshade, which imposes limitations on design. That is to say, the lampshade must be designed curved. Consequently, the space utilization or aesthetic design might be affected to some extent.

Furthermore, due to their design in circuit and voltage matching, the flicker problem tends to occur in ceiling LED lamps. Flickering elicits easily physiological bad reactions such as headache, blurred vision, distraughtness, and epilepsy. To improve this situation, rectifying and filtering electronic devices should be added and connected electrically with the LED circuit board. Unfortunately, those devices occupy a certain space in the base. Besides, thermal dissipation and circuit organization are problems to be considered.

SUMMARY

An objective of the present invention is to provide a lamp structure. The accommodating cavity of the base is provided for disposing the lamp board. Thereby, the space occupied by the lamp board is reduced and the volume of the overall lamp structure is decreased.

Another objective of the present invention is to provide a lamp structure. When a user cleans or maintaining the lamp, it is avoided that the user might touch the lamp board operating with an AC power source for light emission. Thereby, the danger of electric shock may be prevented.

Still another objective of the present invention is to provide a lamp structure, which may prevent short circuit or failure of the lamp board caused by foreign matters or water influencing the lamp board.

A further objective of the present invention is to provide a lamp structure, which provides a heat dissipating unit to contact the lamp board for improving the thermal dissipation of the lamp board and hence extending the lifetime of the lamp board.

In order to achieve the above objectives and efficacies, the present invention provides a lamp structure, which comprises a base, a lamp board, an insulating unit, a connecting unit, and a lampshade. The base includes an accommodating cavity. The lamp board is disposed in the accommodating cavity. An AC power source is supplied to the lamp board for light emission. The insulating unit covers the opening of the accommodating cavity and is located on one side of the lamp board. The connecting unit includes a body, a thread structure, a first limiting member, and a connecting cavity. One end of the body is the thread structure; the other end thereof is the connecting cavity; the first limiting member is disposed on the side surface of the body. One end of the thread structure passes through the lamp board and is screwed to the bottom of the accommodating cavity. The first limiting member fixes the lamp board. One end of the connecting cavity passes through the insulating unit. The connecting rod includes a rod body and a second limiting member. The second limiting member is disposed on the side surface of the rod body. One end of the rod body is screwed to the connecting cavity. The second limiting member fixes the insulating unit. The lampshade is disposed on the other end of the rod body and covers the accommodating cavity of the base. While removing the lampshade, since the insulating unit is fixed by the connecting rod, the insulating unit will cover the opening of the accommodating cavity, preventing touching directly the lamp board conducted with the AC power source.

An objective of the present invention is to disclose that a recess is disposed on one inner side of the accommodating cavity. The accommodating cavity communicates with the recess. A capacitor is disposed in the recess and connected electrically with the lamp board.

An objective of the present invention is to disclose that the accommodating cavity includes a plurality of accommodating-cavity holes. The periphery of the lamp board includes a plurality of notches corresponding to the plurality of accommodating-cavity holes. Each of a plurality of fixing members includes a fixing part and a limiting pillar, respectively. The limiting pillar is disposed on the fixing part. The fixing parts of the plurality of fixing members are screwed to the plurality of accommodating-cavity holes, respectively. The limiting pillars of the plurality of fixing members pass through the plurality of notches, respectively.

An objective of the present invention is to disclose that the lamp structure further comprises a washer, a nut, and a bottom lid. The other end of the connecting rod passes through the lampshade. Then the washer is put around subsequently. The nut is screwed to the other end of the connecting rod and pushes against the washer. The washer presses the lampshade. The lampshade is fixed to the base. The bottom lid covers the nut and the washer and is thus disposed on the lampshade.

An objective of the present invention is to disclose that the lamp structure further comprises a heat dissipating unit disposed at the bottom of the accommodating cavity and located on the other side of the lamp board.

An objective of the present invention is to disclose that the heat dissipating unit includes a hole. An opening is disposed extending from the hole to the outer side of the heat dissipating unit.

An objective of the present invention is to disclose that a recess is disposed on one inner side of the accommodating cavity. The accommodating cavity communicates with the recess. The direction of the opening of the heat dissipating unit corresponds to the recess of the accommodating cavity. A capacitor circuit is disposed in the recess. The wires of the capacitor circuit are organized via the opening and connected electrically to the lamp board.

An objective of the present invention is to disclose that the lamp structure further comprises an auxiliary heat dissipating unit disposed between the heat dissipating unit and the bottom of the accommodating cavity.

An objective of the present invention is to disclose that the lamp structure further comprises a plurality of buckles disposed surrounding the periphery of the accommodating cavity and buckled to the periphery of the insulating unit.

DETAILED DESCRIPTION

In order to make the structure and characteristics as well as the effectiveness of the present invention to be further understood and recognized, the detailed description of the present invention is provided as follows along with embodiments and accompanying figures.

Figure 1A:
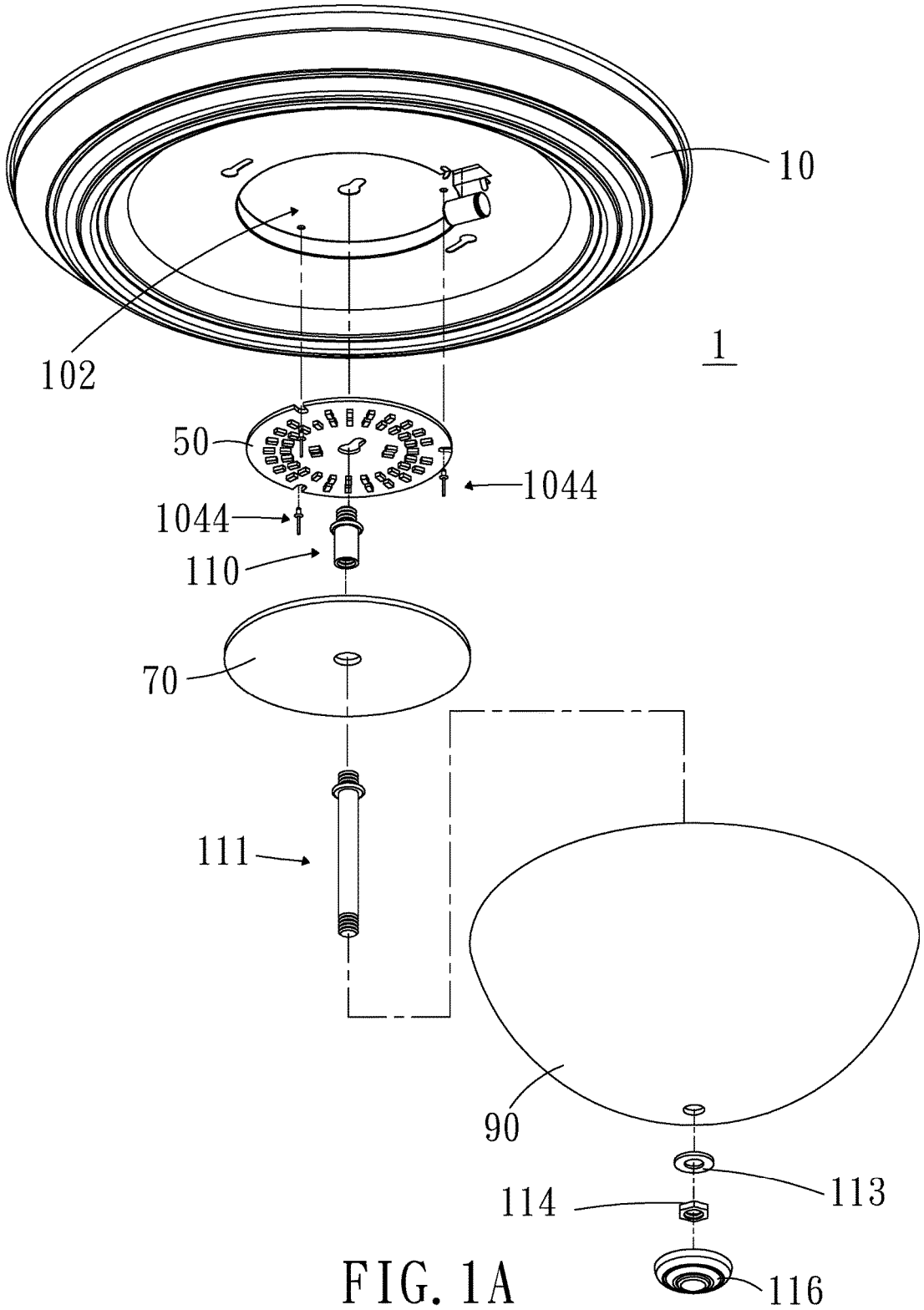
FIG. 1A shows an exploded view of the lamp structure according to the first embodiment of the present invention.
Figure 1B:
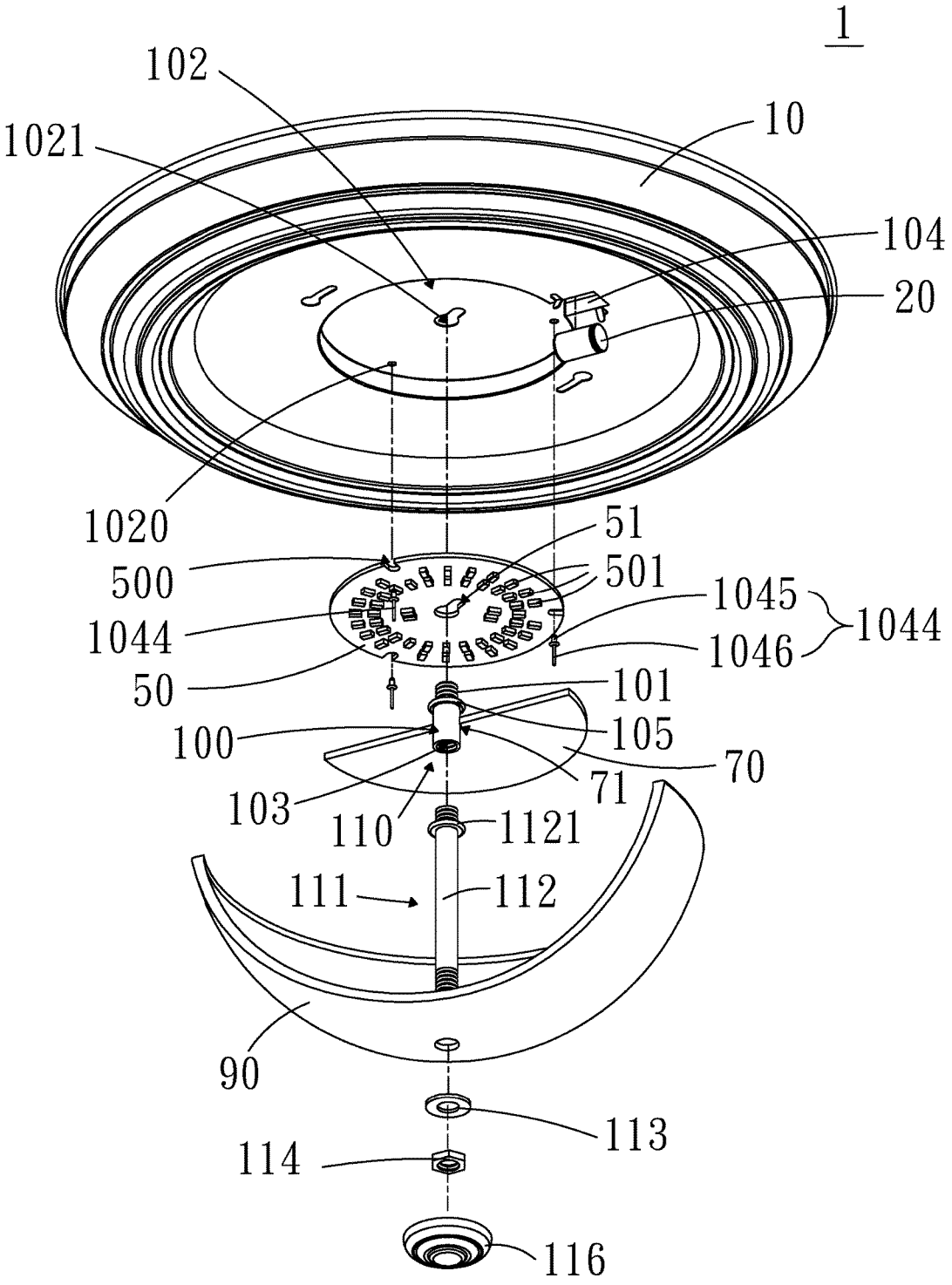
FIG. 1B shows a cross-sectional exploded view of the lamp structure according to the first embodiment of the present invention.
Figure 2:
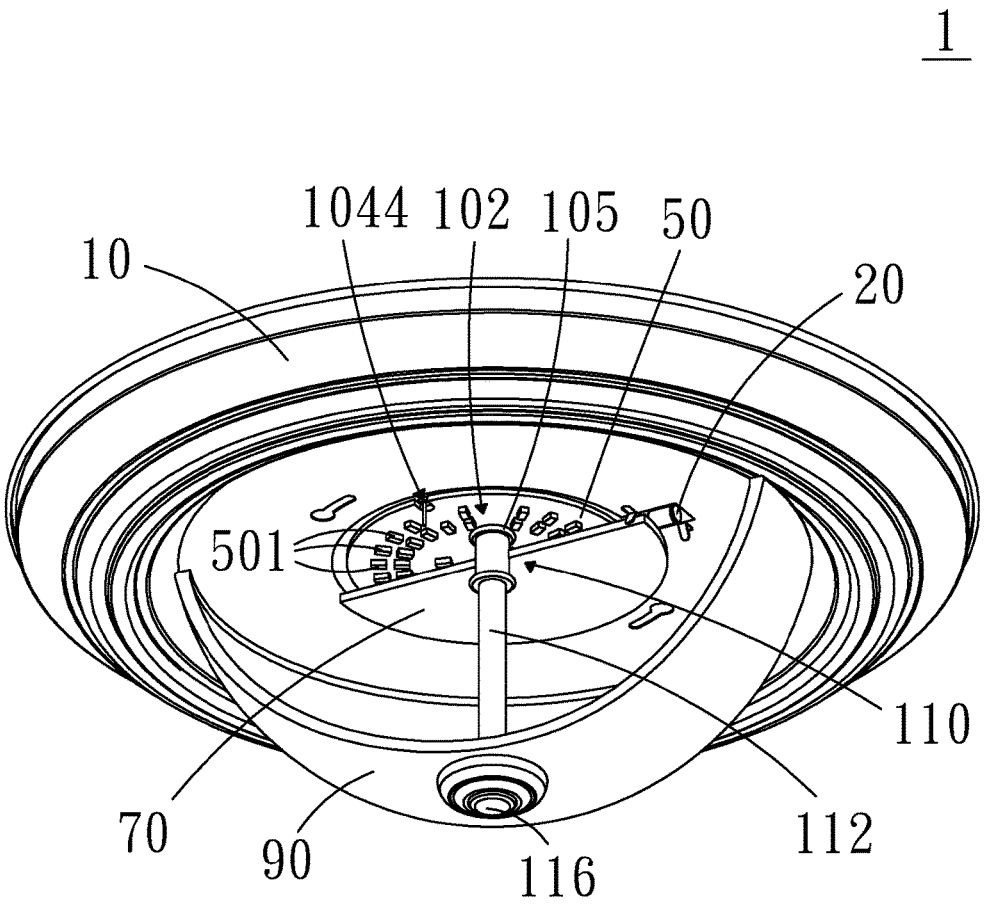
FIG. 2 shows a cross-sectional assembly view of the lamp structure according to the first embodiment of the present invention.

Please refer to FIGS. 1A to 2, which show an exploded view, a cross-sectional exploded view, and a cross-sectional assembly view of the lamp structure according to the first embodiment of the present invention. As shown in the figures, the present embodiment provides a lamp structure 1, which comprises a base 10, a lamp board 50, a connecting unit 110, a connecting rod 111, and a lampshade 90. Except FIG. 1A, the lampshade 90 and the insulating unit 70 according to the present invention are illustrated using stereoscopic cross-sectional views instead of complete structures.

One side of the base 10 is fixed on a wall (not shown in the figures). The other side of the base 10 opposing to the wall is an accommodating cavity 102. The lamp board 50 is disposed in the accommodating cavity 102. The lamp board 50 includes a plurality of LEDs 501. The accommodating cavity 102 includes a plurality of accommodating-cavity holes 1020. A plurality of notches are disposed on the periphery of the lamp board 50 corresponding to the accommodating-cavity holes 1020. Each of a plurality of fixing members 1044 includes a fixing part 1045 and a limiting pillar 1046, respectively. The limiting pillar 1046 is disposed on the fixing part 1045. The fixing parts 1045 of the plurality of fixing members 1044 are screwed to the plurality of accommodating-cavity holes 1020. The limiting pillars 1046 of the plurality of fixing members 1044 pass through the plurality of notches 500, respectively, for limiting the movement of the lamp board 50 and keeping the lamp board 50 inside the accommodating cavity 102. The insulating unit 70 is a transparent glass round board having the functions of insulation and protection. Nonetheless, according to the present embodiment, the material of the insulating unit 70 is not limited; any material having the property of insulation and perviousness to light may be adopted. The insulating unit 70 is disposed on the base and seals the opening of the accommodating cavity 102. Besides, the insulating unit 70 is located on one side of the lamp board 50.

In addition, a first hole 71, a second hole 51, and a third hole 1021 are disposed at the centers of the insulating unit 70, the lamp board 50, and the bottom of the accommodating cavity 102, respectively. The connecting unit 110 includes a body 100, a thread structure 101, a first limiting member 105, and a connecting cavity 103. One end of the body 100 is the thread structure 101; the other end thereof is the connecting cavity 103. The first limiting member 105 is disposed on the side surface of the body 100. The thread structure 101 of the connecting unit 110 passes through the second hole 51 and is screwed to the third hole 1021. In other words, the connecting unit 110 is fixed to the bottom of the accommodating cavity 102. The first limiting member 105 presses against the periphery of the second hole 51 of the lamp board 50 such that the lamp board 50 is fixed inside the accommodating cavity 102. The connecting cavity 103 of the connecting unit 110 passes through the first hole 71 of the insulating unit 70.

Moreover, the lamp structure 1 further comprises a connecting rod 111, a lampshade 90, a washer 113, a nut 114, and a bottom lid 116. According to the first embodiment, the end of the connecting unit 110 having the connecting cavity 103 passes through the first hole 71 of the insulating unit 70. The connecting rod includes a rod body 112 and a second limiting member 1121. The second limiting member 1121 is disposed on the side surface of the rod body 112. One end of the rod body 112 is screwed to the connecting cavity 103. Besides, the second limiting member 1121 presses against the periphery of the first hole 71 of the insulating unit 70 such that the insulating unit 70 is fixed to the opening of the accommodating cavity 102. The other end of the connecting rod 111 passes through the lampshade 90. The lampshade 90 is bowl-shaped with the curved surface facing outwards and the concave facing the direction of the lamp board 50.

Furthermore, the other end of the connecting rod 111 passes through the lampshade 90. Then the washer 113 is put around subsequently. The nut 114 is screwed to the other end of the connecting rod 111 and pushes against the washer 113. The washer 113 presses curved surface of the lampshade 90 such that the lampshade 90 is fixed to the base 10. The washer 113 may prevent the nut 114 from screwing too tight, which will damage the surface of the lampshade 90. In addition, the washer 113 may also increase the friction to the lampshade 90 exerted by the nut 114, so that the lampshade 90 may be pushed against the base 10 more firmly. Besides, the bottom lid 116 covers the nut 114 and the washer 113 and is thus disposed on the lampshade 90. Thereby, the fixed connection between the nut 114 and the connecting rod 111 may be protected.

According to the present embodiment, an AC power source is supplied to the lamp board 50. Nonetheless, the present embodiment does not limit the method for supply power. Alternatively, depending on requirements, the lamp board 50 may be supplied by a DC power source. The lamp board 50 is disposed in the accommodating cavity 102. Then the insulating unit 70 covers the opening of the accommodating cavity 102 so that the lamp board 50 is sealed within the accommodating cavity 102. In other words, the lamp board 50 is located within the accommodating cavity 102 and isolated from the exterior. As the user maintains or cleans the lamp structure 1, the bottom lid 116, the nut 114, and the washer 113 need to be disassembled sequentially. Next, the lampshade 90 and the connecting rod 111 are removed. At this moment, the user may see directly the structures including the base 10, the lamp board 50, and the insulating unit 70. Thereby, according to the internal structure, whether maintenance or cleaning is required may be judged. In this condition, the AC power has not been disconnected from the lamp structure 1 yet. Once the lamp board 50 is touched at this time, it is still possible to suffer from electric shock. Fortunately, if electrical leakage occurs in the lamp board 50, the insulating unit 70 may prevent the user from touching the lamp board 50 and thus avoiding electric shock. In particular, when an AC power source is supplied, if the user touches the lamp board 50 accidentally and suffers from an electric shock, the damage on the human body is severe because the voltage is between 110 and 220 volts. According to the present embodiment, the light emitted by the plurality of LEDs 501 of the lamp board 50 transmits through the insulating unit 70.

The present embodiment provides a lamp structure 1. The advantages of the lamp structure 1 is that the accommodating cavity 102 of the base 10 may save the space between the base 10 and the lampshade 90 and hence reducing the volume of the lamp structure 1 and enabling variations of the overall design. In addition, the insulating unit 70 seals the opening of the accommodating cavity 102 of the base 10 and isolating the lamp board 50 from the exterior. Thereby, when the user cleans or maintains the lamp structure 1, thanks to the isolation provided by the insulating unit 70, the user may be isolated from the lamp board 50 having electrical leakage, and thus avoiding electric shocks. Alternatively, the insulating unit 70 may be used for protecting the lamp board 50. The influences of foreign matters or water on the lamp board 50, which may lead to damages on the circuit board of the lamp board 50, may be avoided.

Please refer again to FIG. 1B. A recess 104 is disposed on one inner side of the accommodating cavity 102 of the lamp structure 1. The accommodating cavity 102 communicates with the recess 104. One or more capacitor 20 is disposed in the recess 104 and connected electrically with the lamp board 50. The capacitor 20 may solve the design problem of the circuit of the lamp board 50. It also improves the flickering problem by voltage matching. The introduction of the recess 104 may also free the space in the base 10 for the capacitor 20 and reducing the overall volume of the lamp structure 1. Depending on the requirements, a plurality of capacitors 20 may be disposed in the recess 104. Alternatively, the related electronic devices that may facilitate improving the performance of the lamp board 50 may be further disposed.

Figure 3:
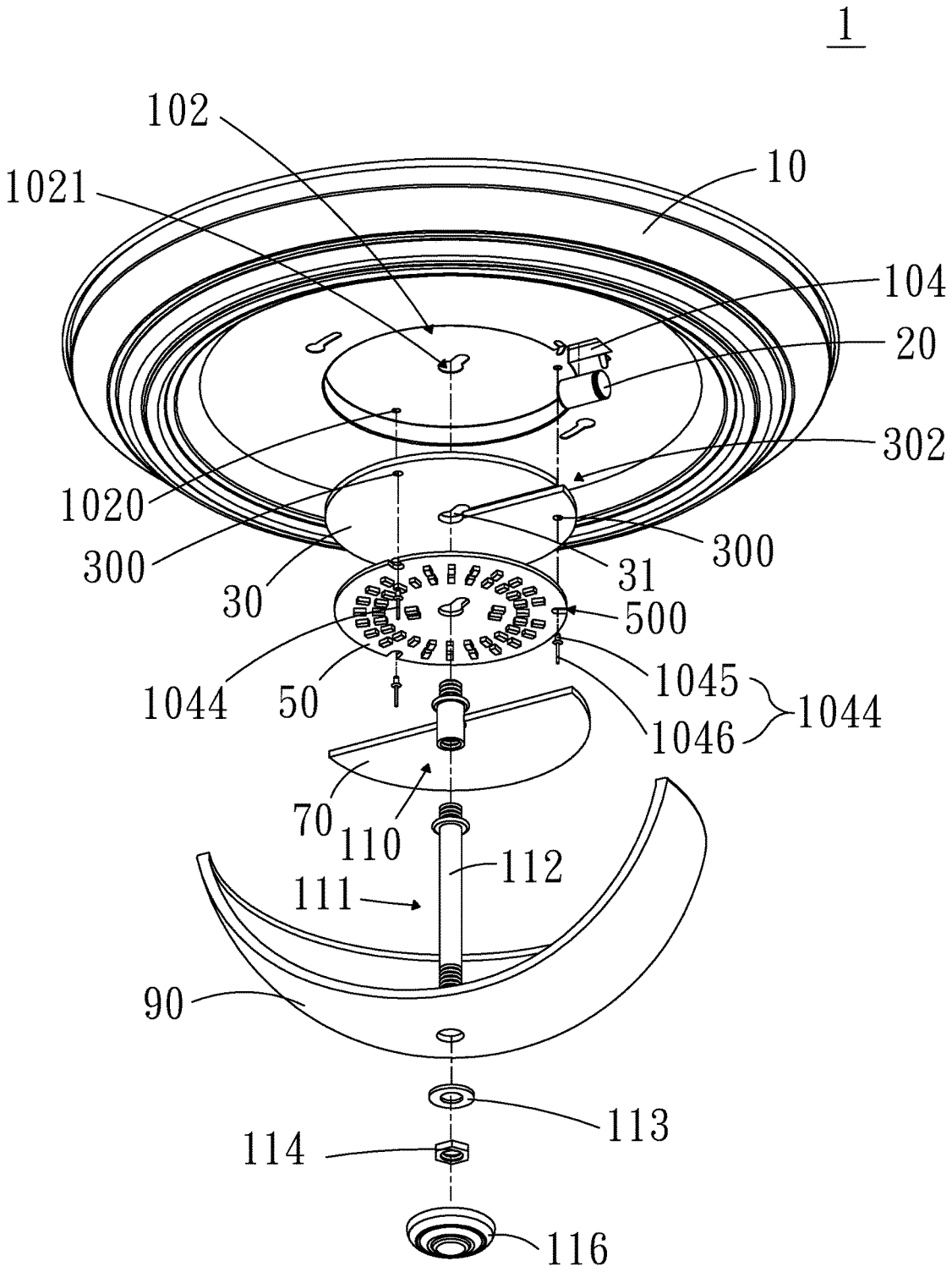
FIG. 3 shows a cross-sectional exploded view of the lamp structure according to the second embodiment of the present invention.

Please refer to FIG. 3, which shows a cross-sectional exploded view of the lamp structure according to the second embodiment of the present invention. As shown in the figure, the difference between the present embodiment and the first one is that the lamp structure 1 according to the present embodiment further comprises a heat dissipating unit 30 disposed at the bottom of the accommodating cavity 102. The lamp board 50 is then disposed on the heat dissipating unit 30. Namely, the heat dissipating unit 30 is located on the other side of the lamp board 50. The heat dissipating unit 30 includes a plurality of heat dissipating holes 300 corresponding to the plurality of accommodating-cavity holes 1020. The fixing parts 1045 of the plurality of fixing members 1044 pass through the heat dissipating holes 300 and are screwed to the accommodating-cavity holes 1020. Thereby, the lamp board 50 may contact the heat dissipating unit 30 directly. The heat generated by the lamp board 50 may be conducted to the base 10 via the heat dissipating unit 30, and then to the wall on which the base 10 is installed. Thereby, the heat may be dissipated from inside to the outside. The material of the heat dissipating unit 30 is aluminum. Nonetheless, according to users' requirements, other materials beneficial to heat dissipation may be adopted as well.

In addition, according to the present embodiment, the heat dissipating unit 30 is a round plate. A hole 31 is located at the center of the heat dissipating unit 30. An opening 302 is disposed extending from the hole 31 to the outer side of the heat dissipating unit 30. This opening 302 allows the wires of the lamp board 50 connected to the base 10 to be accommodated and to pass therethrough. Thereby, the wires will not be pressed or damaged and hence reducing the factors of circuit failure. After the circuit between the lamp board 50 and the base 10 is completed, since the opening 302 is located on one side of the heat dissipating unit 30, the heat dissipating unit 30 may be installed conveniently on the side and between the lamp board 50 and the bottom of the accommodating cavity 102.

Besides, the direction of the opening 302 of the heat dissipating unit 30 corresponds to the recess 104 of the accommodating cavity 102. Thereby, the wires of the capacitor 20 in the recess 104 may be accommodated in and organized by the opening 302 and then connected to the lamp board 50. Thanks to the function of the opening 302, the probability that the wires of the capacitor 20 are pressed by the base 10 and the lamp board 50 is reduced, and thus reducing the concern of damaging them. As a result, the lifetime of the capacitor 20 may be increased and the maintenance cost may be lowered.

Figure 4:
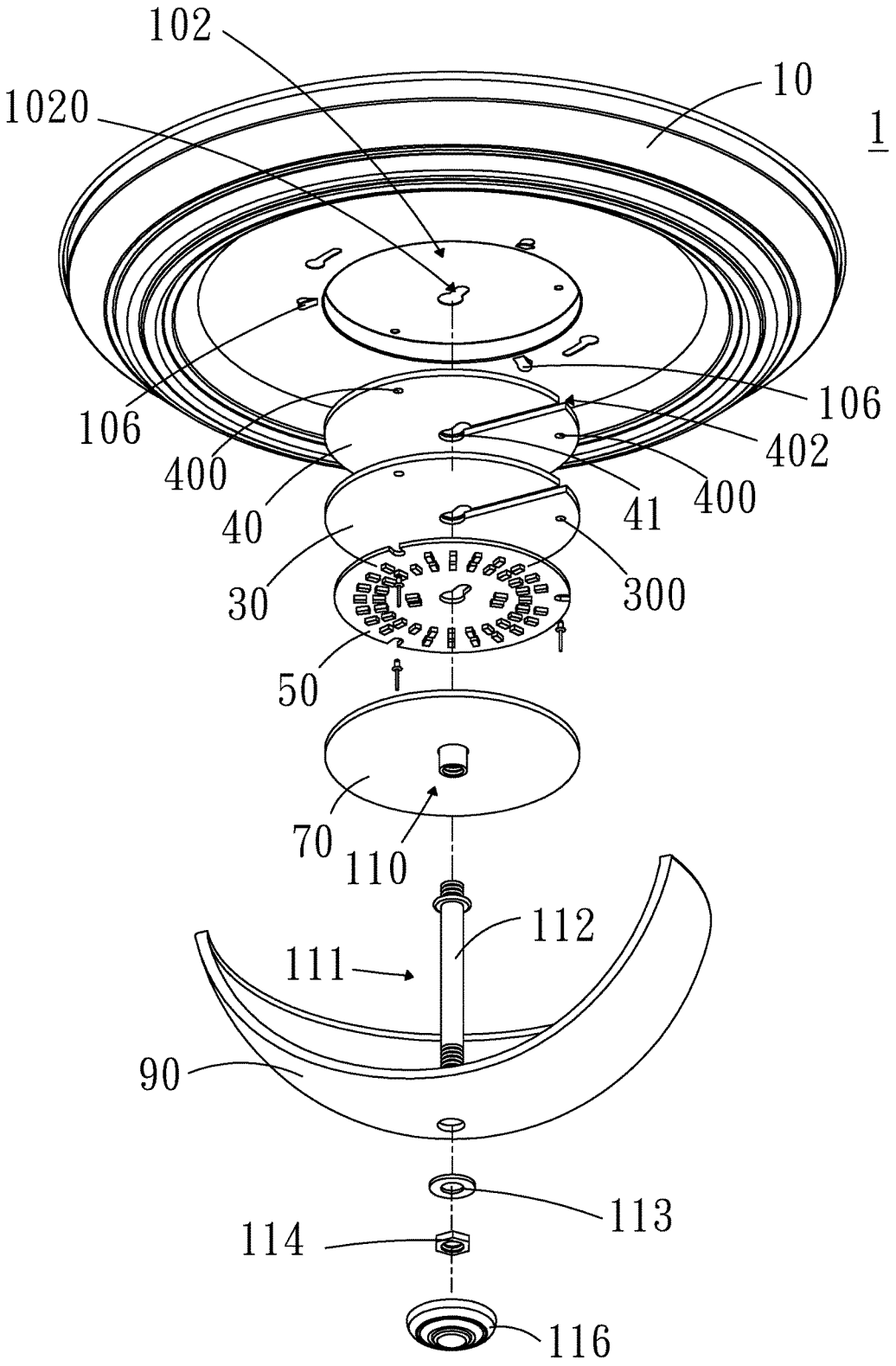
FIG. 4 shows a cross-sectional exploded view of the lamp structure according to the third embodiment of the present invention.

Please refer to FIG. 4, which shows a cross-sectional exploded view of the lamp structure according to the third embodiment of the present invention. As shown in the figure, the difference between the present embodiment and the second one is that the present embodiment further comprises an auxiliary heat dissipating unit 40 disposed between the heat dissipating unit 30 and the accommodating cavity of the base 10. The auxiliary heat dissipating unit 40 is a round plate and made of thermally conductive silica gel, which is a soft thermally conductive material. In addition to facilitating heat dissipation of the lamp board 50, silica gel may also lessen the pressure on the lamp board 50. Hence, it provides protection and buffering functions for the lamp board 50.

Moreover, by using the auxiliary heat dissipating unit 40 together with the heat dissipating unit 30, the heat dissipation of the lamp board 50 may be enhanced. According to user' requirement, the materials of the heat dissipating unit 30 and the auxiliary heat dissipating unit 40 may be other materials beneficial to heat dissipation and not limited to those as described above. Besides, the structure of the auxiliary heat dissipating unit 40 is identical to that of the heat dissipating unit 30. It includes an auxiliary hole 41. It also includes an auxiliary opening 402 extending outwards from the hole 41. In addition, the auxiliary heat dissipating unit 40 also includes auxiliary heat dissipating holes 400. The functions of the auxiliary hole 41, the auxiliary opening 402, and the auxiliary heat dissipating holes 400 as described above are identical to the functions of the hole 31, the opening 302, and the heat dissipating holes 300, respectively. Hence, the details will not be described again.

Besides, in order to enhance protecting the lamp board 50 inside the accommodating cavity 102, the lamp structure 1 further comprises a plurality of buckles 106 disposed surrounding the periphery of the accommodating cavity 102. The insulating unit 70 may be fixed to the opening of the accommodating cavity 102 using the buckles 106 and located on one side of lamp board 50. Thereby, the stability and firmness of the insulating unit 70 may be enhanced effectively.

To sum up, the lamp structure according to the present invention comprises a base, a lamp board, and an insulating unit. The base includes an accommodating cavity. The lamp board is disposed in the accommodating cavity. The insulating unit seals the opening of the accommodating cavity and is located on one side of the lamp board. Thereby, the function of the accommodating cavity is to save the space between the base and the lampshade and thus thinning the lamp structure. In addition, the insulating unit seals the opening of the accommodating cavity and isolate the lamp board from the exterior environment. Consequently, when a user cleans or maintains the lamp structure, direct contact of the lamp board having electrical leakage, which leads to electric shock, may be avoided. Besides, the insulating unit may protect the lamp board from damages caused by foreign matters or water from the environment. Moreover, the heat dissipating unit or/and the auxiliary heat dissipating unit is disposed between the bottom of accommodating cavity and the lamp board for facilitating heat dissipation of the lamp structure and extending its lifetime.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

What is claimed is:

1. A lamp structure, comprising:

a base, having an accommodating cavity;

a lamp board, disposed inside said accommodating cavity, and receiving an alternate-current power source for emitting light;

an insulating unit, sealing an opening of said accommodating cavity, and located on one side of said lamp board;

a connecting unit, having a body, a thread structure, a first limiting member, and a connecting cavity, one end of said body being said thread structure, the other end of said body being said connecting cavity, said first limiting member disposed on the side surface of said body, one end of said thread structure passing through said lamp board and screwed to a bottom of said accommodating cavity, said first limiting member fixing said lamp board, and one end of said connecting cavity passing through said insulating unit;

a connecting rod, having a rod body and a second limiting member, said second limiting member disposed on the side surface of said rod body, one end of said rod body screwed to said connecting cavity, and said second limiting member fixing said insulating unit; and a lampshade, disposed on the other end of said rod body, and covering said accommodating cavity of said base;

where when said lampshade is removed, said insulating unit is fixed by said connecting rod and seals the opening of said accommodating cavity, said insulating unit preventing direct contact of said lamp board running at the alternate-current power.

2. The lamp structure of claim 1, wherein a recess is disposed on an inner side of said accommodating cavity; said accommodating cavity communicates with said recess; and a capacitor is disposed in said recess and connected electrically to said lamp board.

3. The lamp structure of claim 1, wherein said accommodating cavity includes a plurality of accommodating-cavity holes; said lamp board includes a plurality of notches on a periphery corresponding to said plurality of accommodating-cavity holes; a plurality of fixing member includes a fixing part and a limiting pillar, respectively; said limiting pillar is disposed on said fixing part; said fixing part of said plurality of fixing members are screwed to said plurality of accommodating-cavity holes, respectively; and said limiting pillars of said plurality of fixing members pass through said plurality of notches, respectively.

4. The lamp structure of claim 1, and further comprising a washer, a nut, and a bottom lid, the other end of said connecting rod passing through said lampshade and said washer being put around sequentially, said nut screwed to the other end of said connecting rod and pressing said washer; said washer pressing said lampshade, said lampshade fixed on said base, and said bottom lid covering said nut and said washer and disposed on said lampshade.

5. The lamp structure of claim 1, and further comprising a heat dissipating unit, disposed at the bottom of said accommodating cavity and located on the other side of said lamp board.

6. The lamp structure of claim 5, wherein said heat dissipating unit includes a hole and an opening extending outwards from said hole of said heat dissipating unit.

7. The lamp structure of claim 6, wherein a recess is disposed on an inner side of said accommodating cavity; said accommodating cavity communicates with said recess; the direction of said opening of said heat dissipating unit corresponds to said recess of said accommodating cavity; a circuit of a capacitor is located inside said recess and organized by said opening before connecting electrically to said lamp board.

8. The lamp structure of claim 5, and further comprises an auxiliary heat dissipating unit disposed between said heat dissipating unit and the bottom of said accommodating cavity.

9. The lamp structure of claim 1, and further comprising a plurality of buckles disposed surrounding a periphery of said accommodating cavity and buckled to a periphery of said insulating unit.

* * * * *